US007938711B1

(12) United States Patent
Johnston

(10) Patent No.: US 7,938,711 B1
(45) Date of Patent: May 10, 2011

(54) ADJUSTABLE SPORTS BRASSIERE

(76) Inventor: Yvonne Johnston, Herperus, CO (US)

( * ) Notice: Subject to any disclaimer, the term of this patent is extended or adjusted under 35 U.S.C. 154(b) by 414 days.

(21) Appl. No.: 12/156,842

(22) Filed: Jun. 5, 2008

(51) Int. Cl.
*A41C 3/00* (2006.01)

(52) U.S. Cl. ..... 450/86; 450/1

(58) Field of Classification Search ..... 450/1, 2, 450/14–16, 82, 86–88, 20, 74–77, 79
See application file for complete search history.

(56) References Cited

U.S. PATENT DOCUMENTS

| | | | | | |
|---|---|---|---|---|---|
| 2,590,915 | A | * | 4/1952 | Allison | 450/82 |
| 2,602,929 | A | * | 7/1952 | Chasinov | 450/82 |
| 2,638,596 | A | * | 5/1953 | Fridolph | 450/82 |
| 2,668,954 | A | * | 2/1954 | Frohlich | 450/82 |
| 4,607,640 | A | | 8/1986 | McCusker | |
| 4,816,005 | A | | 3/1989 | Braaten | |
| 4,957,466 | A | | 9/1990 | Hopps | |
| 5,244,432 | A | | 9/1993 | Moy Au et al. | |
| D351,711 | S | | 10/1994 | Mattson | |
| 5,823,851 | A | | 10/1998 | Dicker | |
| D403,486 | S | | 1/1999 | Chetwynd | |
| 6,083,080 | A | | 7/2000 | Lawson | |
| 6,123,601 | A | * | 9/2000 | Hildebrandt | 450/82 |
| 6,135,853 | A | * | 10/2000 | Hopson | 450/86 |
| D438,691 | S | | 3/2001 | Zagame | |
| 6,994,606 | B2 | * | 2/2006 | Li | 450/82 |
| 7,081,035 | B2 | * | 7/2006 | Kawakami | 450/59 |
| 7,115,015 | B2 | | 10/2006 | Horii et al. | |
| 7,677,952 | B2 | * | 3/2010 | Wooley | 450/81 |

* cited by examiner

*Primary Examiner* — Gloria Hale
(74) *Attorney, Agent, or Firm* — Montgomery Patent and Design; Robert C. Montgomery

(57) ABSTRACT

An improved sports brassiere possessing multiple enhancements comprising adjustable wider straps for increased comfort, high quality stretch material, and two (2) adjustment points on either side thus ensuring a perfect fit, is herein disclosed. The front of the brassiere is provided with a connecting point between the brassiere cups comprising a strong snap design suitable for use during various rough sporting activities such as horseback riding and motorcycle riding. The brassiere is also provided with underwire supports and a large quantity of lace material across the upper portion of each cup for enhanced aesthetic quality.

18 Claims, 3 Drawing Sheets

ADJUSTABLE SPORTS BRASSIERE

RELATED APPLICATIONS

The present invention was first described in an Official Record of Invention on Apr. 25, 2007 that is on file at the offices of Montgomery Patent and Design, LLC, the entire disclosures of which are incorporated herein by reference.

FIELD OF THE INVENTION

The present invention relates generally to an improved fitting and aesthetically pleasing sports brassiere comprising multiple points of adjustability, form-fitting means, comforting means, and aesthetically pleasing means.

BACKGROUND OF THE INVENTION

The brassiere is a common article of underclothing that provides support for women's breasts as well as enhancing their figure. A particular type of brassiere that has found favor in recent years is that of the sports bra. It is designed for use by women engaged in sporting activities and thus allows for increased support and enhanced freedom of movement. However, many women find the conventional sports bra lacking in several areas. First, it provides inadequate support during rough sporting activities such as horseback riding, motorcycle riding, and the like. Secondly, it has a lack adjustment features which makes it uncomfortable for use during extended periods of time. Finally, sports bras are almost never found with lace trim thus decreasing its appeal for women looking for a feminine touch. Accordingly, there exists a need for a means by which sports brassieres can be provided with features that address the above mentioned deficiencies. The development of the invention herein described fulfills this need.

U.S. Pat. No. 7,115,015 filed by Horii and Funahashi discloses sport clothing with cups. This patent does not appear to disclose an adjustable sports bra.

U.S. Pat. No. D 438,691 filed by Zagame discloses a sports bra. This design patent does not appear to be similar in appearance to the disclosed invention nor does it appear to disclose an adjustable sports bra with underwire support.

U.S. Pat. No. D 403,486 filed by Chetwynd discloses a ladies sports garment. This design patent does not appear to be similar in appearance to the disclosed invention nor does it appear to disclose an adjustable sports bra with adjustability.

U.S. Pat. No. 6,083,080 filed by Lawson and Miller discloses a protective brassiere with local energy absorption. This patent does not appear to disclose an adjustable sports bra that possesses a "T" shaped back panel nor does it appear to offer multipoint adjustability or enhanced comfort to the wearer.

U.S. Pat. No. D 351,711 filed by Mattson discloses a sports brassiere. This design patent does not appear to disclose a similar design to that of the instant invention nor does it appear to disclose an adjustable sports bra that possesses a "T" shaped back panel nor does it appear to offer multipoint adjustability or enhanced comfort to the wearer with a front closure mechanism.

U.S. Pat. No. 5,823,851 filed by Dicker discloses a bra sport top. This patent does not appear to disclose an adjustable sports bra with as few straps as the instant invention nor does it appear to disclose a bra with multipoint adjustability through a plurality of hooks and straps.

U.S. Pat. No. 5,244,432 filed by Au and Unsworth discloses a protective and supportive brassiere. This patent does not appear to disclose an adjustable sports bra that possesses a "T" shaped back panel nor does it appear to offer multipoint adjustability for enhanced comfort to the wearer.

U.S. Pat. No. 4,957,466 filed by Hopps discloses an athletic supporter for women which wraps around the upper torso of a wearer. This patent does not appear to disclose a brassiere type device that possesses separate cups for each breast with underwire support.

U.S. Pat. No. 4,816,005 filed by Braaten discloses a sports bra. This patent does not appear to disclose an adjustable sports bra that possesses multipoint adjustability for enhanced comfort through a plurality of hooks and straps.

U.S. Pat. No. 4,607,640 filed by McCusker discloses an athletic/industrial brassiere with protective inserts. This patent does not appear to disclose an adjustable sports bra that possesses a "T" shaped back panel nor does it appear to offer multipoint adjustability or enhanced comfort to the wearer.

The prior art discloses various brassieres and other devices to support the upper body of women during sporting or other strenuous activities through the use of zippers or wrap around types of mechanisms. The prior art doe not appear to disclose an adjustable sports bra that features multipoint adjustability with underwire support, a "T" shaped back panel and a front closure mechanism for enhanced comfort and aesthetic appeal.

SUMMARY OF THE INVENTION

In view of the foregoing disadvantages inherent in the prior art, it has been observed that there is a need for an adjustable sports bra.

It is an object of the adjustable sports bra to provide a means for an improved brassiere possessing multiple enhancements comprising wider adjustable straps for increased comfort, wider adjustable side panels ensuring no rolling up and a perfect fit, an oversized front closure mechanism suitable for use during sporting activities, as well as enhanced aesthetic features.

It is another object of the adjustable sports bra to comprise similar construction, features, and functions found in various brassieres as well as several enhancements, thereby providing increased comfort, stability, and adjustability to a user.

A further object of the adjustable sports bra provides a user with four (4) points of adjustability, thereby allowing said user to create a custom fit of the adjustable sports bra thereto a variety of torso sizes and shapes when worn in conjunction therewith particular anticipated work, leisure, or sports activities.

An aspect of the adjustable sports bra comprises a pair of lower cups, a pair of upper cups, a front closure mechanism, a pair of side panels, and a pair of straps. The lower cups comprise a form-fitting convex-shaped enclosure made using a high quality satin material formed with a shape-retaining satin weave using filament fibers. The lower cups are made of a medium to low-stretch fabric, thereby maintaining sufficient form and support to the adjustable sports bra during vigorous activities. Each lower cup provides an attachment means thereto an upper cup portion along an upper edge using conventional sewing techniques. The lower and upper cups are envisioned to be introduced in a variety of popular cup sizes and widths based on a user's preference. Additionally, the lower cups, upper cups, and side panels are envisioned to be provided in a variety of fashionably contrasting or matching colors and patterns also based upon a user's preference.

Another aspect of the adjustable sports bra comprises an upper cup which is a continuous upward projection of the convex contour of the attached lower cup portion. The upper cup comprises a lace panel approximately one (1) to three (3) inches high providing an aesthetic characteristic thereto the adjustable sports bra. The lace upper cups are envisioned to be a high quality knit openwork fabric made by machine or by hand and is envisioned to be introduced in a variety of attractive knitted patterns and textures.

A further aspect of the adjustable sports bra comprises attachment means for the lower and upper cup assemblies via a front closure mechanism. The front closure mechanism comprises a strong plastic interlocking device further comprising vertical male and female locking elements having cylindrical or rectangular shapes. The front closure mechanism possesses a quick-release function thereto the adjustable sports bra while enabling a user to retain a per-adjusted fit. The front closure is envisioned to comprise an over-sized version of similar closure devices commonly used on a variety of brassieres.

Yet still another aspect of the adjustable sports bra comprises lower cups with an integral underwire located along an entire lower peripheral edge of said lower cup. The underwires provide a conventional supporting means thereto the adjustable sports bra. Each underwire member comprises an arcuate shape supporting a breast using a preferably a stainless steel round wire material being entirely enclosed therewithin a sewn fabric tunnel with closed ends, thereby providing comfort to a user. A lower side region of each underwire, and associated fabric covering, defines a textile transition means thereto affixed side panels along opposing extremities of the lower cups. The side panels comprise extra-wide elastic panels extending laterally therearound a user's rib area.

Still a further aspect of the adjustable sports bra comprises an attachment means from the lower and upper cup assemblies to a pair of straps at an upper location via common sewn seams. The straps provide vertical support thereto the adjustable sports bra in a conventional manner with particular additional features providing increased comfort, stability, and adjustability thereto the adjustable sports bra. The straps provide lateral stability thereto the adjustable sports bra reducing possible slipping off one's shoulder area during use and/or while participating in various activities.

Yet another aspect of the adjustable sports bra comprises a pair of straps that extend vertically downward across a back region comprising an integral adjustable fastener. Each strap is slidingly engaged therethrough the adjustable fastener, looped therethrough a common 2-rib plastic slide fastener at a lower end thereof the strap, and terminated using a sewn loop therein being affixed thereto a center rib portion of said adjustable fastener in a conventional manner. The adjustable fastener comprises an appropriately sized common 3-rib plastic tri-glide strap length adjusting device being common in the industry. The slide fasteners provide an attachment means thereto a back panel portion via a sewn seam.

Yet still another aspect of the adjustable sports bra comprises a back panel with an elastic fabric panel having an inverted "T"-shape and a center section extending upwardly, being sized proportionally thereto a particular sized adjustable sports bra. The back panel further comprises a horizontal lower section approximately three (3) inches high extending laterally and being affixed thereto the aforementioned side panels via a plurality of hooks and loops. The back panel is envisioned to be made using an omni-directionally elastic nylon or polyester fabric section, thereby providing interactive linear compliancy thereto the two (2) straps 50 and the two (2) side panels. The back panel further comprises sewn-in hooks located at each opposing outer end.

Still another aspect of the adjustable sports bra comprises a plurality of hooks and loops. The hooks comprise a vertically arranged column of three (3) sewn-in metal latching devices located at each opposing outer end of the back panel. The hooks provide a fastening means thereto corresponding loop portions being sewn-in and integral thereto the side panels. The loops are arranged in two (2) parallel vertical columns positioned approximately one (1) inch apart, thereby providing a multiplicative adjustment means thereto the adjustable sports bra including a side panel length adjustment, a side-to-side back panel adjustment, and an overall perimeter length adjustment thereto the adjustable sports bra. The hooks and loops comprise common sewn-in metal devices similar to those used in various brassieres.

A method for installing and utilizing the adjustable sports bra may be achieved by performing the following steps: unlatching the front closure; applying the adjustable sports bra to one's torso by looping the straps over one's arms in a normal manner; adjusting in turn each strap using the adjustable fasteners to obtain a correct shoulder height; adjusting the side panel length as required using the hooks and loops; latching the front closure; flexing one's torso in such a way as to test for a comfortable secure fit of the adjustable sports bra; repeating adjustments of the first straps and/or side panels as required, until achieving a desired fit; retaining an adjusted fit of the adjustable sports bra as obtained using the previously described adjustments, by using the front closure mechanism to quickly remove the adjustable sports bra; and, benefiting from increased adjustability and resulting comfort and stability of the adjustable sports bra during activities such as horseback riding, hiking, motorcycle riding, and every day use.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
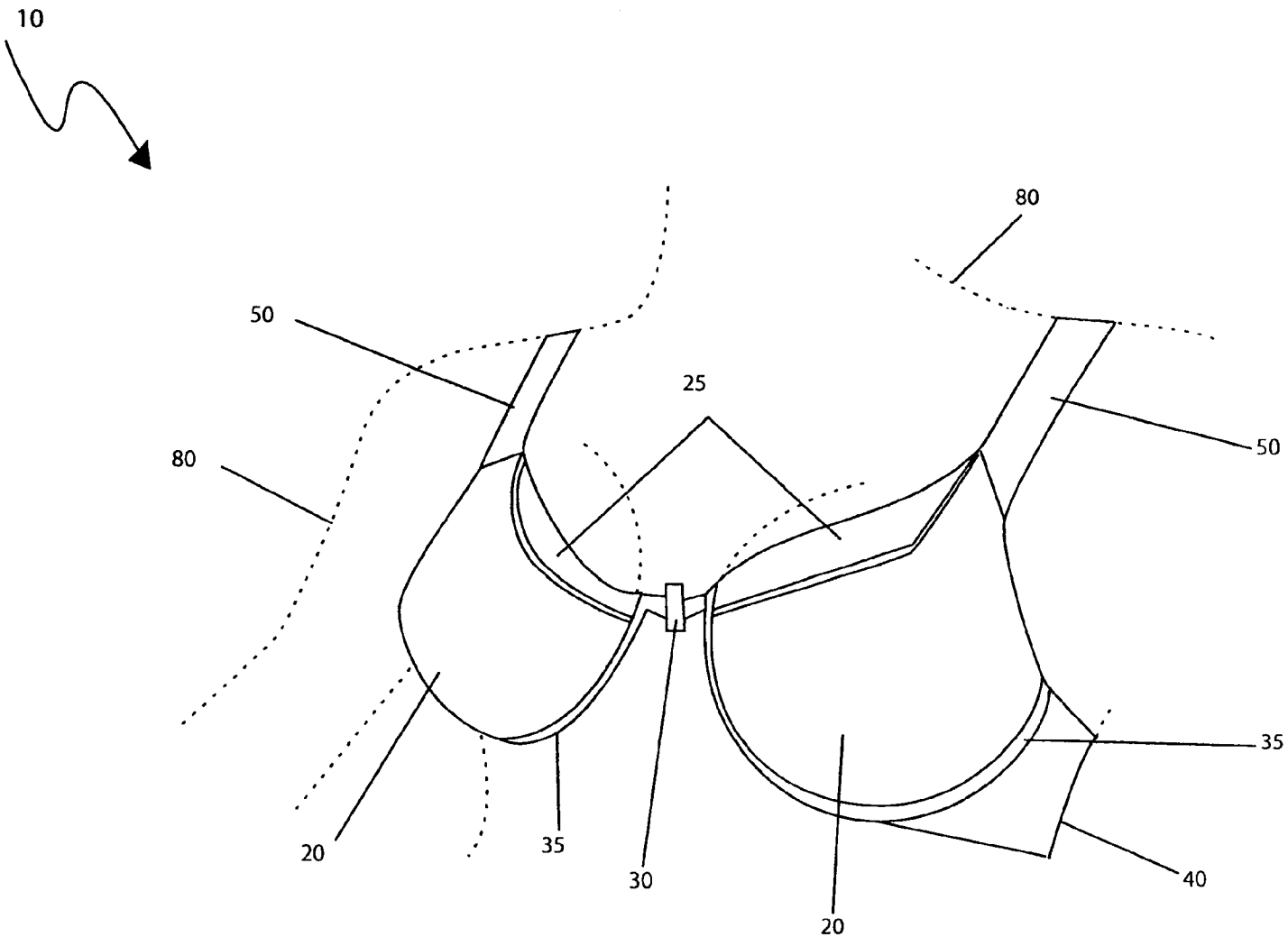
FIG. 1 is a front view of an adjustable sports bra 10, according to a preferred embodiment of the present invention.

10 adjustable sports bra
20 lower cup
25 upper cup
30 front closure mechanism
35 under wire
40 side panel
50 strap
55 adjustable fastener
60 slide fastener
67 back panel
70 hook
75 loop
80 user

DETAILED DESCRIPTION OF THE PREFERRED EMBODIMENT

Figure 2:
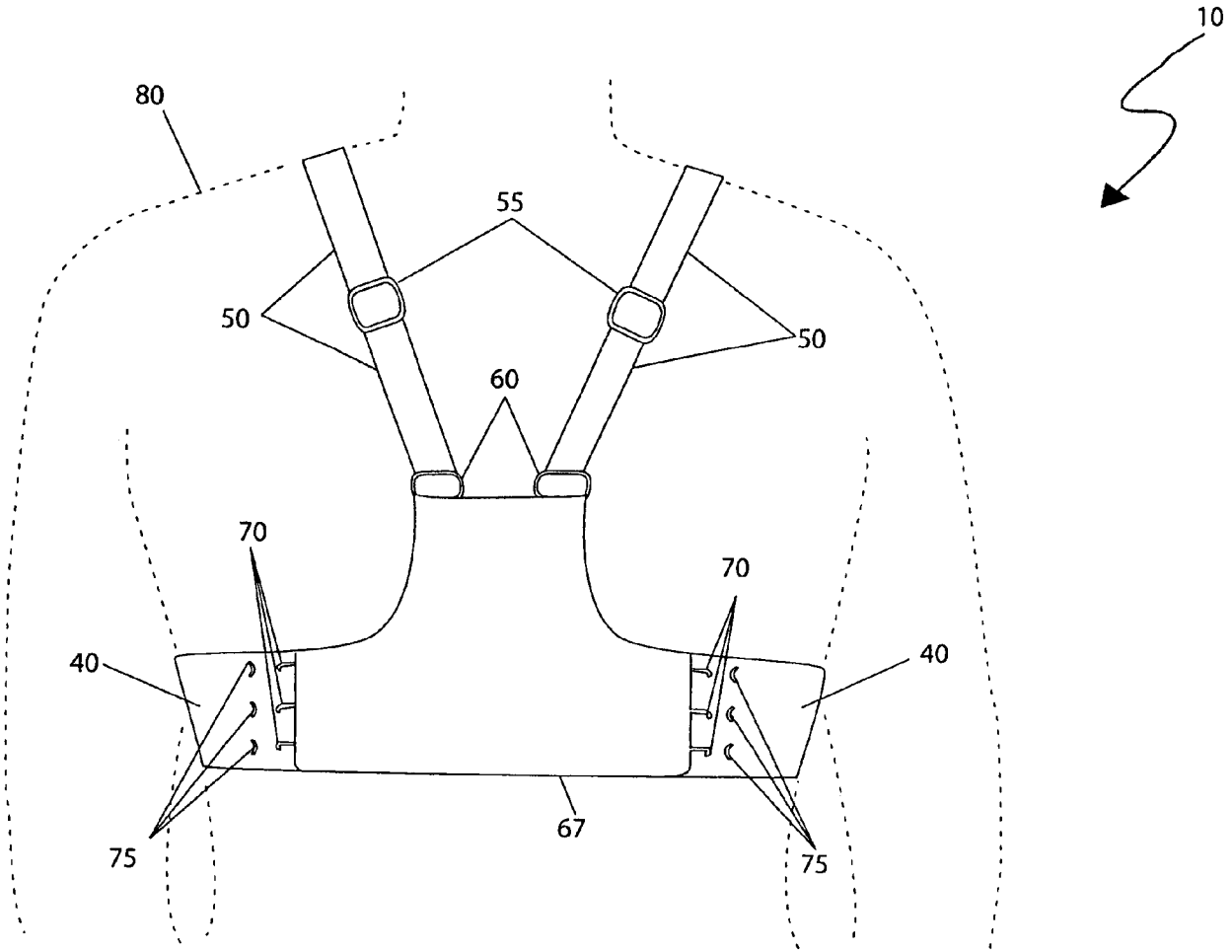
FIG. 2 is a rear view of an adjustable sports bra 10, according to a preferred embodiment of the present invention; and, FIG. 3 is a close-up detailed view of a back panel 67 attachment portion, as depicted in FIG. 2, of an adjustable sports bra 10, according to a preferred embodiment of the present invention.
Figure 3:
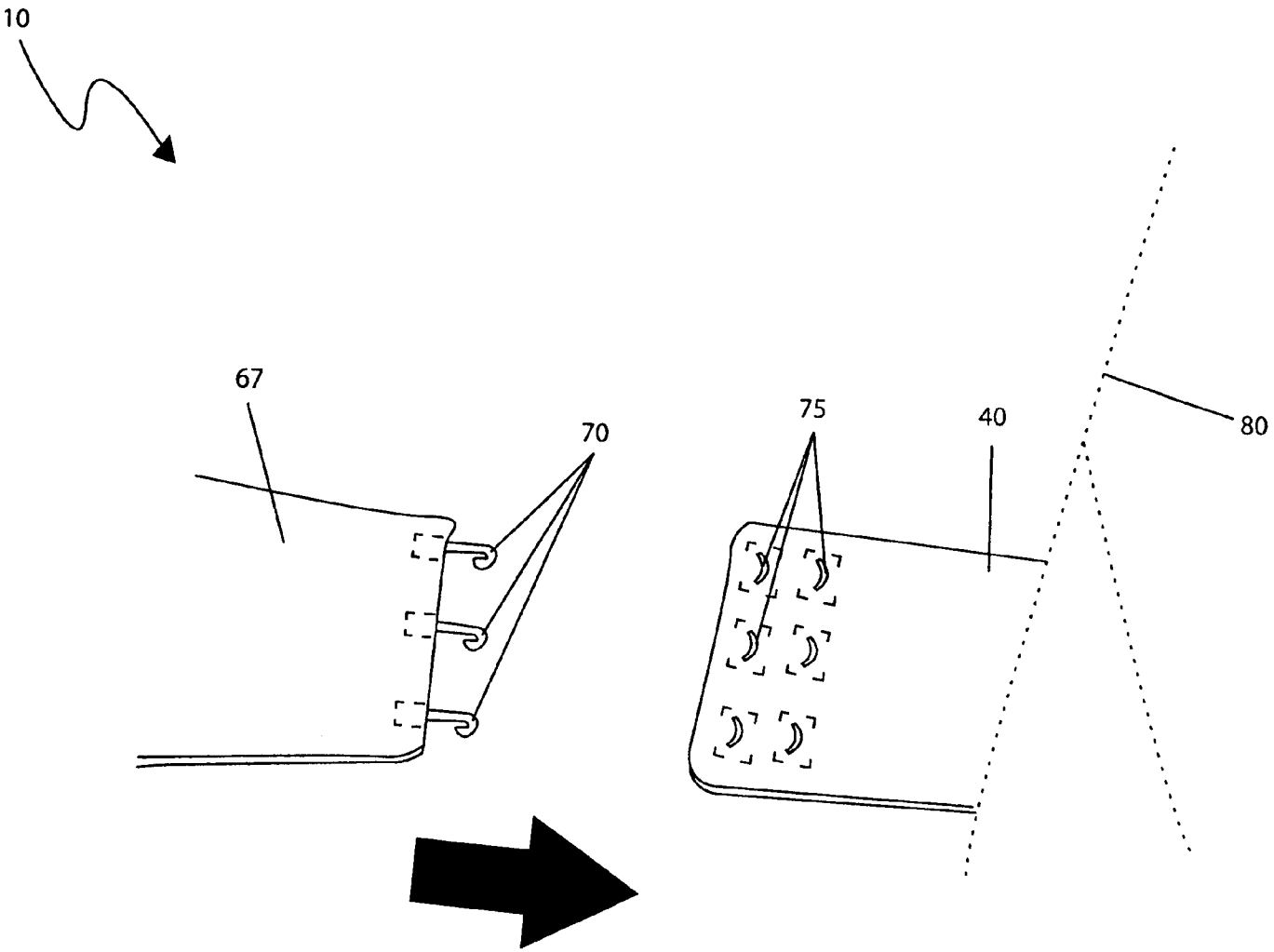

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for an adjustable sports bra 10, which provides a means for an improved brassiere possessing multiple enhancements comprising wider adjustable straps 50 for increased comfort, wider adjustable side panels 40 ensuring no rolling up and a perfect fit, an oversized front closure mechanism 30 suitable for use during sporting activities, as well as enhanced aesthetic features.

Referring now to FIG. 1, a front perspective view of the adjustable sports bra 10, according to the preferred embodiment of the present invention, is disclosed. The adjustable sports bra 10 comprises a pair of lower cups 20, a pair of upper cups 25, a front closure mechanism 30, a pair of side panels 40, and a pair of straps 50. The adjustable sports bra 10 comprises similar construction, features, and functions found in various brassieres as well as several enhancements, thereby providing increased comfort, stability, and adjustability to a user 80.

The lower cups 20 comprise a form-fitting convex-shaped enclosure made using a high quality satin material formed with a shape-retaining satin weave using filament fibers such as silk, nylon, or polyester. The lower cups 20 are envisioned to be made of a medium to low-stretch fabric, thereby maintaining sufficient form and support to the adjustable sports bra 10 during vigorous activities. Each lower cup 20 provides an attachment means thereto an upper cup portion 25 along an upper edge using conventional sewing techniques. The upper cup 25 comprises a continuous upward projection of the convex contour of the attached lower cup portion 20. The upper cup 25 comprises a lace panel approximately one (1) to three (3) inches high providing an aesthetic characteristic thereto the adjustable sports bra 10. Said lace upper cups 25 are envisioned to be a high quality knit openwork fabric made by machine or by hand and is envisioned to be introduced in a variety of attractive knitted patterns and textures.

The lower 20 and upper 25 cup assemblies provide an attachment means thereto one another via a front closure mechanism 30. The front closure mechanism 30 comprises a strong plastic interlocking device further comprising vertical male and female locking elements having cylindrical or rectangular shapes. The front closure mechanism 30 provides a quick-release function thereto the adjustable sports bra 10 providing a quick-removal means thereto the adjustable sports bra 10 while enabling a user 80 to retain a per-adjusted fit. The front closure 30 is envisioned to comprise an oversized version of similar closure devices commonly used on a variety of braziers, thereby providing increased security during vigorous activities such as horseback riding, hiking, and motorcycle riding while maintaining a quick-release function. The front closure mechanism 30 is envisioned to be made in a plastic injection molding process common in the industry.

The lower cups 20 further comprise an integral underwire 35 located along an entire lower peripheral edge of said lower cup 20. The underwires 35 provide a conventional supporting means thereto the adjustable sports bra 10 in an expected manner. Each underwire member 35 comprises an arcuate shape supporting a breast using a preferably a stainless steel round wire material being entirely enclosed therewithin a sewn fabric tunnel with closed ends, thereby providing comfort to a user 80. The underwires 35 are envisioned to be covered using conventional sewing techniques and similar material to that of the lower cups 20. A lower side region of each underwire 35, and associated fabric covering, defines a textile transition means thereto affixed side panels 40 along opposing extremities of the lower cups 20 using conventional sewing techniques. The side panels 40 comprise extra-wide elastic panels extending laterally therearound a user's rib area 80. The side panels 40 provide a comfortable elastic member made using an omni-directional elastic nylon or polyester fabric section approximately three (3) inches wide, thereby reducing possible "rolling-up" of said side panels 40 during use (see FIG. 2).

The lower 20 and upper 25 cup assemblies further provide an attachment means thereto a pair of straps 50 at an upper location via common sewn seams. The straps 50 provide vertical support thereto the adjustable sports bra 10 in a conventional manner with particular additional features providing increased comfort, stability, and adjustability thereto the adjustable sports bra 10. The straps 50 provide lateral stability thereto the adjustable sports bra 10 being approximately one (1) to one-and-a-half (1½) inches wide, thereby reducing possible slipping off one's shoulder area 80 during use and/or while participating in various activities. The straps 50 further comprise rugged textile strapping elements made preferably using medium to low-stretch nylon tricot fabric; however, they may be provided using equivalent rugged strapping materials common in the industry. The straps 50 extend vertically upward passing over an apex of a user's shoulders 80 to a back area in an expected fashion (see FIG. 2).

The lower 20 and upper 25 cups are envisioned to be introduced in a variety of popular cup sizes and widths based on a user's preference. Additionally, the lower cups 20, upper cups 25, and side panels 40 are envisioned to be provided in a variety of fashionably contrasting or matching colors and patterns also based upon a user's preference.

Referring now to FIG. 2, a rear view of an adjustable sports bra 10, according to the preferred embodiment of the present invention, is disclosed. The adjustable sports bra 10 is illustrated here comprising a pair of side panels 40, a back panel 67, a pair of straps 50, a pair of adjustable fasteners 55, a pair of slip fasteners 60, a plurality of hooks 70, and a plurality of loops 75. The adjustable sports bra 10 provides a user 80 with four (4) points of adjustability, thereby allowing said user 80 to create a custom fit of the adjustable sports bra 10 thereto a variety of torso sizes and shapes 80 when worn in conjunction therewith particular anticipated work, leisure, or sports activities.

The aforementioned straps 50 (see FIG. 1) extend vertically downward across a back region comprising an integral adjustable fastener 55. Each strap 50 is slidingly engaged therethrough the adjustable fastener 55, looped therethrough a common 2-rib plastic slide fastener 60 at a lower end thereof the strap 50, and terminated using a sewn loop therein being affixed thereto a center rib portion of said adjustable fastener 55 in a conventional manner. The adjustable fastener 55 is envisioned to comprise an appropriately sized common 3-rib plastic tri-glide strap length adjusting device being common in the industry. The slide fasteners 60 provide an attachment means thereto a back panel portion 67 via a sewn seam using conventional sewing techniques.

The back panel 67 comprises an elastic fabric panel having an inverted "T"-shape and a center section extending upwardly being approximately three (3) to four (4) inches wide and four (4) to six (6) inches high, being sized proportionally thereto a particular sized adjustable sports bra 10. The back panel 67 further comprises a horizontal lower section approximately three (3) inches high extending laterally and being affixed thereto the aforementioned side panels 40 via a plurality of hooks 70 and loops 75. The back panel 67 is envisioned to be made using an omni-directionally elastic nylon or polyester fabric section, thereby providing interactive linear compliancy thereto the two (2) straps 50 and the two (2) side panels 40. The back panel 67 further comprises sewn-in hooks 70 located at each opposing outer end thereof (see FIG. 3).

The straps 50 and adjusting devices described above are envisioned to be introduced in a variety of fashionably contrasting or matching colors and patterns based upon a user's preference.

Referring now to FIG. 3, a close-up detailed view of a back panel 67 attachment portion as depicted in FIG. 2, of an adjustable sports bra 10, according to a preferred embodiment of the present invention, is disclosed. The adjustable sports bra 10 comprises a plurality of hooks 70 and loops 75. The hooks 70 comprise a vertically arranged column of three (3) sewn-in metal latching devices located at each opposing outer end of the back panel 67. The hooks 70 provide a fastening means thereto corresponding loop portions 75 being sewn-in and integral thereto the side panels 40. The loops 75 are arranged in two (2) parallel vertical columns positioned approximately one (1) inch apart, thereby providing a multiplicative adjustment means thereto the adjustable sports bra 10 including a side panel 40 length adjustment, a side-to-side back panel 67 adjustment, and an overall perimeter length adjustment thereto the adjustable sports bra 10. The hooks 70 and loops 75 comprise common sewn-in metal devices similar to those used in various braziers; however, it is understood that other equally rugged fastening means may be provided such as, but not limited to: hook-and-loop, snaps, latches, or other fasteners.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the adjustable sports bra 10, it would be installed as indicated in FIGS. 1 and 2.

The method of installing and utilizing the adjustable sports bra 10 may be achieved by performing the following steps: unlatching the front closure 30; applying the adjustable sports bra 10 to one's torso 80 by looping the straps 50 over one's arms 80 in a normal manner; adjusting in turn each strap 50 using the adjustable fasteners 55 to obtain a correct shoulder height; adjusting the side panel 40 length as required using the hooks 70 and loops 75; latching the front closure 30; flexing one's torso 80 in such a way as to test for a comfortable secure fit of the adjustable sports bra 10; repeating adjustments of the first straps and/or side panels 40 as required, as described above, until achieving a desired fit; retaining an adjusted fit of the adjustable sports bra 10 as obtained using the previously described adjustments, by using the front closure mechanism 30 to quickly remove the adjustable sports bra 10; and, benefiting from increased adjustability and resulting comfort and stability of the adjustable sports bra 10 during activities such as horseback riding, hiking, motorcycle riding, and every day use.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An adjustable sports bra comprising:

a pair of cups, each further comprising:

a lower cup portion having a form-fitting convex-shaped enclosure, each lower cup portion having an integral underwire located along an entire lower peripheral edge of said lower cup portion;

a corresponding upper cup portion attached to said lower cup portion, each upper cup portion having a continuous upward projection of a convex contour of said lower cup portion;

a front closure having an interlocking device comprising a male locking element and a female locking element removably engaged to each other;

a pair of side panels extending laterally around a user rib area, each having a plurality of loops located at an end thereof;

a pair of straps extending vertically upward and passing over an apex of user shoulders to a user back area for providing a vertical support and lateral stability to said adjustable sport bra, said pair of straps being slidingly engaged through a pair of adjustable fasteners and further looped through a pair of slide fasteners that are attached to said pair of straps; and, a back panel comprising:

an inverted T-shaped elastic panel having a lower horizontal section extending laterally having one end affixed to one of said pair of side panels with a plurality of hooks and an opposite end affixed to the second one of said pair of side panels with a plurality of hooks; and, a center section extending upwardly from said horizontal section.

2. The adjustable sports bra of claim 1, wherein said underwire supports said adjustable sports bra and comprises a lower side region, said underwire further including a fabric covering affixed to said pair of side panels along opposing extremities of each of said lower cup portions.

3. The adjustable sports bra of claim 1, wherein each of said lower cup portions is directly attached to each of said upper cup portions.

4. The adjustable sports bra of claim 1, wherein each of said pair of side panels is formed from elastic material.

5. The adjustable sports bra of claim 1, wherein said pair of straps is attached to an upper location of each of said upper cup portions and said lower cup portions respectively.

6. The adjustable sports bra of claim 1, wherein said plurality of hooks comprises: a vertically arranged column of hooks located at each opposing outer end of said back panel.

7. The adjustable sports bra of claim 1, wherein said plurality of loops is arranged in two columns positioned apart.

8. The adjustable sports bra of claim 1, wherein said pair of slide fasteners is attached to said back panel.

9. An adjustable sports bra comprising:

a pair of cups, each further comprising:

a lower cup portion having a form-fitting convex-shaped enclosure, each lower cup portion having an integral underwire located along an entire lower peripheral edge of said lower cup portion, said integral underwire having an arcuate shape supporting a breast;

a corresponding upper cup portion attached to said lower cup portion, each upper cup portion having a continuous upward projection of a convex contour of said lower cup portion;

a front closure having an interlocking device comprising a male locking element and a female locking element removably engaged to each other;

a pair of side panels extending laterally around a user rib area, each having a plurality of loops located at an end thereof;

a pair of straps extending vertically upward and passing over an apex of user shoulders to a user back area for providing a vertical support and lateral stability to said adjustable sport bra, said pair of straps further extending vertically downward across said user back area and being slidingly engaged through a pair of adjustable fasteners and further looped through a pair of slide fasteners that are operably attached at a lower end of said pair of straps; and, a back panel comprising:

an inverted T-shaped elastic fabric panel having a lower horizontal section extending laterally having one end affixed to one of said pair of side panels with a plurality of hooks and an opposite end affixed to the second one of said pair of side panels with a plurality of hooks; and, a center section extending upwardly from said horizontal section and sized proportionally to a particular size of said adjustable sports bra.

10. The adjustable sports bra of claim 9, wherein said underwire supports said adjustable sports bra and comprises a lower side region, said underwire further including a fabric covering affixed to said pair of side panels along opposing extremities of each of said lower cup portions.

11. The adjustable sports bra of claim 9, wherein each of said lower cup portions is directly attached to each of said upper cup portions.

12. The adjustable sports bra of claim 9, wherein each of said pair of side panels is formed from elastic material.

13. The adjustable sports bra of claim 9, wherein said pair of straps is attached to an upper location of each of said upper cup portions and said lower cup portions respectively.

14. The adjustable sports bra of claim 9, wherein said plurality of hooks comprises: a vertically arranged column of hooks located at each opposing outer end of said back panel.

15. The adjustable sports bra of claim 9, wherein said plurality of loops is arranged in two (2) columns positioned apart.

16. The adjustable sports bra of claim 9, wherein said pair of slide fasteners is attached to said back panel.

17. A method of using an adjustable sports bra, said method comprising the steps of:

providing a pair of cups, each further comprising: a lower cup portion having a form-fitting convex-shaped enclosure, each lower cup portion having an integral underwire located along an entire lower peripheral edge of said lower cup portion, said integral underwire having an arcuate shape supporting a breast, and a corresponding upper cup portion attached to said lower cup portion, each upper cup portion having a continuous upward projection of a convex contour of said lower cup portion;

providing a front closure having an interlocking device comprising a male locking element and a female locking element removably engaged to each other;

providing a pair of side panels extending laterally around a user rib area, each having a plurality of loops located at an end thereof;

providing a pair of straps extending vertically upward and passing over an apex of user shoulders to a user back area for providing a vertical support and lateral stability to said adjustable sport bra, said pair of straps further extending vertically downward across said user back area and being slidingly engaged through a pair of adjustable fasteners and further looped through a pair of slide fasteners that are operably attached at a lower end of said pair of straps; and, providing a back panel comprising:

an inverted T-shaped elastic fabric panel having a lower horizontal section extending laterally having one end affixed to one of said pair of side panels with a plurality of hooks and an opposite end affixed to the second one of said pair of side panels with a plurality of hooks; and, a center section extending upwardly from said horizontal section and sized proportionally to a particular size of said adjustable sports bra.

18. The method of claim 17, further comprising the steps of:

unlatching said front closure;

applying said adjustable sports bra to a user torso by looping said pair of straps over arms of the user;

adjusting each of said straps using said adjustable fasteners to obtain a correct shoulder height;

adjusting a length of each of said side panels by adapting said hooks and said loops to alternate positions;

latching said front closure; and, flexing a user torso in such a way as to test for a comfortable fit of said adjustable sports bra.

* * * * *